US006679324B2

(12) United States Patent
Den Boer et al.

(10) Patent No.: US 6,679,324 B2
(45) Date of Patent: Jan. 20, 2004

(54) DOWNHOLE DEVICE FOR CONTROLLING FLUID FLOW IN A WELL

(75) Inventors: Johannis Josephus Den Boer, GD Rijswijk (NL); Astrid Hartwijk, GD Rijswijk (NL); Gerald Sommerauer, GD Rijswijk (NL); John Foreman Stewart, GD Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/079,199

(22) Filed: Feb. 20, 2002

(65) Prior Publication Data

US 2002/0174981 A1 Nov. 28, 2002

Related U.S. Application Data

(63) Continuation-in-part of application No. 09/561,850, filed on Apr. 28, 2000, now abandoned.

(30) Foreign Application Priority Data

Apr. 29, 1999 (EP) ..... 99303395

(51) Int. Cl.[7] ..... F16K 31/02

(52) U.S. Cl. ..... 166/66.6; 166/316; 166/332.1; 137/827

(58) Field of Search ..... 166/66.6, 316, 166/332.1; 137/806, 827

(56) References Cited

U.S. PATENT DOCUMENTS

| | | | |
|---|---|---|---|
| 5,100,933 | A | 3/1992 | Tanaka et al. |
| 6,015,266 | A | 1/2000 | Swatek |
| 6,158,470 | A | 12/2000 | Ivers et al. |

FOREIGN PATENT DOCUMENTS

| | | |
|---|---|---|
| JP | 2711119 | 10/1988 |
| WO | 92/02005 | 2/1992 |
| WO | 97/02330 | 1/1997 |
| WO | WO 99/10653 | * 3/1999 |

* cited by examiner

*Primary Examiner*—William Neuder

(57) ABSTRACT

There is provided a downhole device for controlling the flow of fluids through an oil and/or gas production well comprises a deformable chamber which contains an electromagnetic field or other stimuli responsive gel and a fluid passage which is closed off in response to a volume increase of the gel and the deformable chamber.

18 Claims, 3 Drawing Sheets

DOWNHOLE DEVICE FOR CONTROLLING FLUID FLOW IN A WELL

This is a continuation-in-part of application Ser. No. 09/561,850 filed Apr. 28, 2000, now abandoned the disclosure of which is here incorporated by reference.

FIELD OF THE INVENTION

The invention relates to a downhole device for controlling fluid flow through a hydrocarbon fluid production well.

BACKGROUND OF THE INVENTION

Numerous devices exist for controlling fluid flow in wells. These devices generally comprise a valve body which opens or closes a fluid passage in response to actuation of the valve body by an electric or hydraulic motor.

Since the fluid pressure and pressure differentials across the downhole valve are generally high, powerful electric or hydraulic motors are required which requires a significant space in the generally narrow wellbore and deployment of high power and high voltage or high pressure electric or hydraulic power supply conduits.

It is an object of the present invention to provide a downhole fluid control device for use in a hydrocarbon production well which is compact and can be operated without requiring high voltage or high pressure power supply conduits.

SUMMARY OF THE INVENTION

The downhole device according to the invention comprises a deformable chamber which contains a stimuli responsive gel, which gel has a volume that varies in response to variation of a selected physical stimulating parameter, and a fluid passage which is closed off in response to a volume increase of at least part of the gel and the deformable chamber.

Preferably the gel is an electromagnetic field responsive gel which releases water if an electromagnetic field of a certain field strength is exerted to the gel and which absorbs water in the absence of an electromagnetic field and the device is equipped with an electromagnetic field transmitter which is adapted to exert an electromagnetic field of a selected field strength to the gel.

DETAILED DESCRIPTION

Suitable electromagnetic field responsive gels are polyacrylamide gels and polymethylacrylic acid gels. Electromagnetic field responsive gels of this type are known from U.S. Pat. No. 5,100,933, International patent application WO 9202005 and Japanese patent No. 2711119. These prior art references disclose that electromagnetic field responsive gels can be used for several applications, such as microcapsules of colourants or medicines, mechanico-chemical memories or switches, sensors, actuators, transducers, memories, controlled release systems and selective pumps.

The known applications are confined to surface equipment and use in relatively small mechanical assemblies which are operated in a controlled environment.

However, applicant has surprisingly discovered that such gels can be applied in a downhole flow control device which operates at high pressure and temperature in a well. The gels can be actuated by an electromagnetic field which is between 0.5 and 50 Volt per cm length of the deformable chamber so that the required power is small in comparison with mechanical valves and can easily be generated by a downhole battery, power cell, power generator and/or transmitted via the wall of the well tubulars.

It is preferred that the gel is contained in a flexible bladder which seals off the fluid passage in response of a volume increase of at least part of the gel in the chamber.

Suitably, the flexible bladder has a toroidal shape and surrounds an orifice in a production liner in the inflow region of an oil and/or gas production well and wherein the gel in the flexible bladder is induced to swell so that the bladder seals off the orifice in response to the detection of influx of water into the well via the orifice.

Alternatively, the flexible bladder has a toroidal shape and is arranged in an annular space between two co-axial production tubing sections of which the walls are perforated near one end of the annular space such that the perforations are closed off in response to a volume increase of at least part of the body of gel within the bladder and the perforations are opened in response to a volume decrease of at least part of the body of gel within the bladder.

It is observed that International patent application WO 97/02330 discloses a drilling composition including non-polyampholite polymers and gels which change their state of hydration in response to an environmental trigger.

The know drilling composition selectively blocks the pores of the stratum surrounding the wellbore and therefore relates to treatment of a stratum outside the wellbore in contrast with the present invention which relates to a downhole flow control device which is arranged inside a wellbore.

Figure 1A:
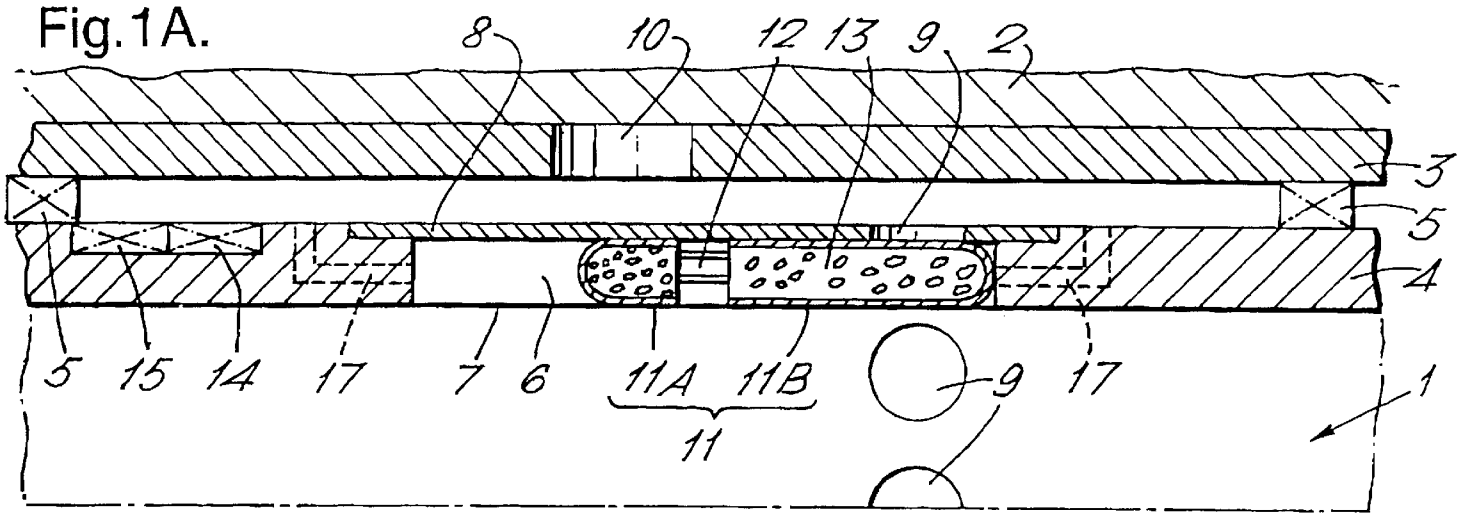
FIG. 1A shows a device according to the invention with a gel-filled bladder in the open position.
Figure 1B:
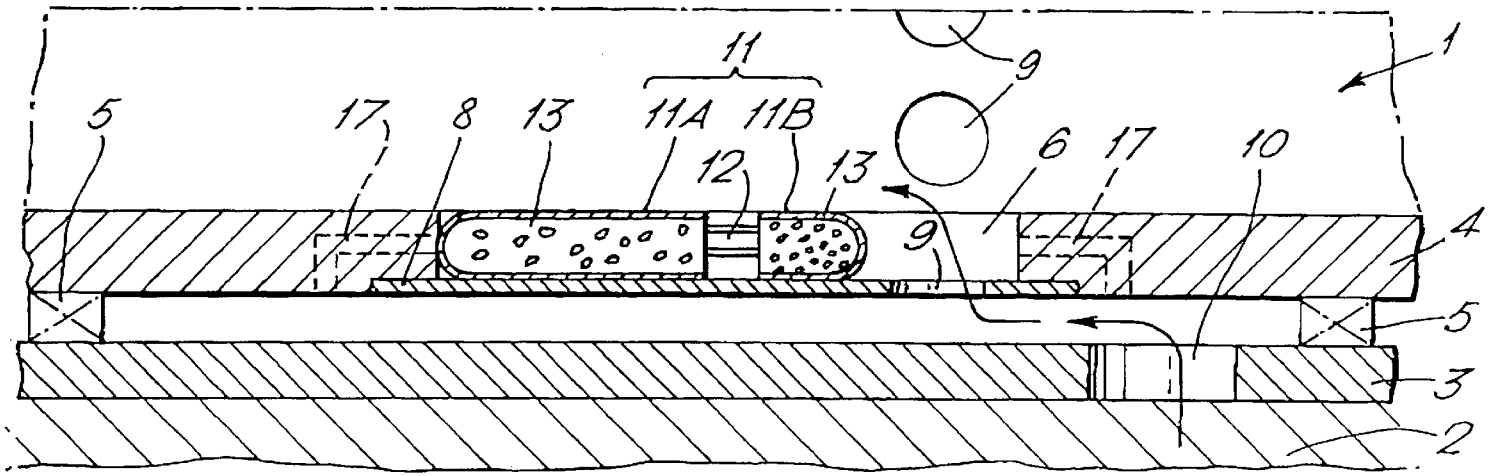
FIG. 1B shows the device of FIG. 1A where the gel-filled bladder closes off the fluid passage.

The invention will be described in more detail with reference to the accompanying drawings. Referring now to FIGS. 1A and 1B there is shown an oil and/or gas production well 1, which traverses an oil and/or gas bearing formation 2.

A well liner 3 provides a lining of the wellbore and perforations 10 in the liner 3 allow oil and/or gas to flow into the well 1 from the surrounding formation.

A sleeve 4 is removably secured within the well liner 3 by means of a pair of inflatable packers 5.

The sleeve 4 comprises an annular space 6 which is formed between an inner and an outer wall 7 and 8 of the sleeve 4 and at the right-hand side of the drawing the annular space 6 both the inner and outer walls of the sleeve comprise perforations 9.

A gel-filled bladder 11 is arranged in the annular space 6. The bladder 11 comprises two segments 11A and 11B which are separated by a bulkhead 12. The bulkhead 12 is permeable to water, but impermeable to the electromagnetic field responsive gel 13 in the bladder segments 11A and 11B.

The sleeve 4 is equipped with a rechargeable battery 14 and an electrical power receiver and/or transmitter assembly 15 which are adapted to exert an electric field to either the first or the second segment 11A or 11B, respectively of the bladder.

The electric field may be exerted to the first bladder segment 11A by a first electromagnetic coil (not shown) embedded in the region of the outer wall 8 of the sleeve which surrounds the first bladder segment 11A and to the second bladder segment 11B by a second electromagnetic coil (not shown) which is embedded in the region of the outer wall 8 of the sleeve which surrounds the second bladder segment 11B. Electrical conduits in the annular space surrounding the outer wall 8 of the sleeve interconnect the electrical power and/or receiver assembly 15 and the electrical coils surrounding the first and second bladder segments 11A and 11B. The electrical power and/or receiver assembly 15 is provided with a switch to supply electrical power solely to either the first or the second coil.

In FIG. 1A the electromagnetic field is exerted to the first segment 11A via a first electromagnetic coil (not shown), as previously described, and water is squeezed out of the gel 13 contained therein through the bulkhead 12 into the second segment 11B in which the gel 13 absorbs water. As a result the bladder 11A is pushed to the right hand side of the drawing and closes off the perforations 9 so that influx of fluids into the interior of the sleeve 4 is prevented. Pressure balancing conduits 17 allow a free movement of the bladder segments 11A and 11B through the annular space 6.

In FIG. 1B the electromagnetic field is exerted to the second segment 11B via a second electromagnetic coil (not shown), as previously described, and water is then squeezed from the gel 13 contained therein into the first segment 11A so that the bladder moves to the left and allows well fluids to flow via the perforations 9 and 10 from the formation 2 into the well 1.

FIG. 2 shows a device substantially similar to that of FIG. 1 and in which similar reference numerals denote similar components, with the exception that in the bladder two water-permeable bulkheads 12A and 12B are arranged between which a body of free water 16 is present to facilitate water to flow easily between the segments 11A and 11B.

Figure 2A:
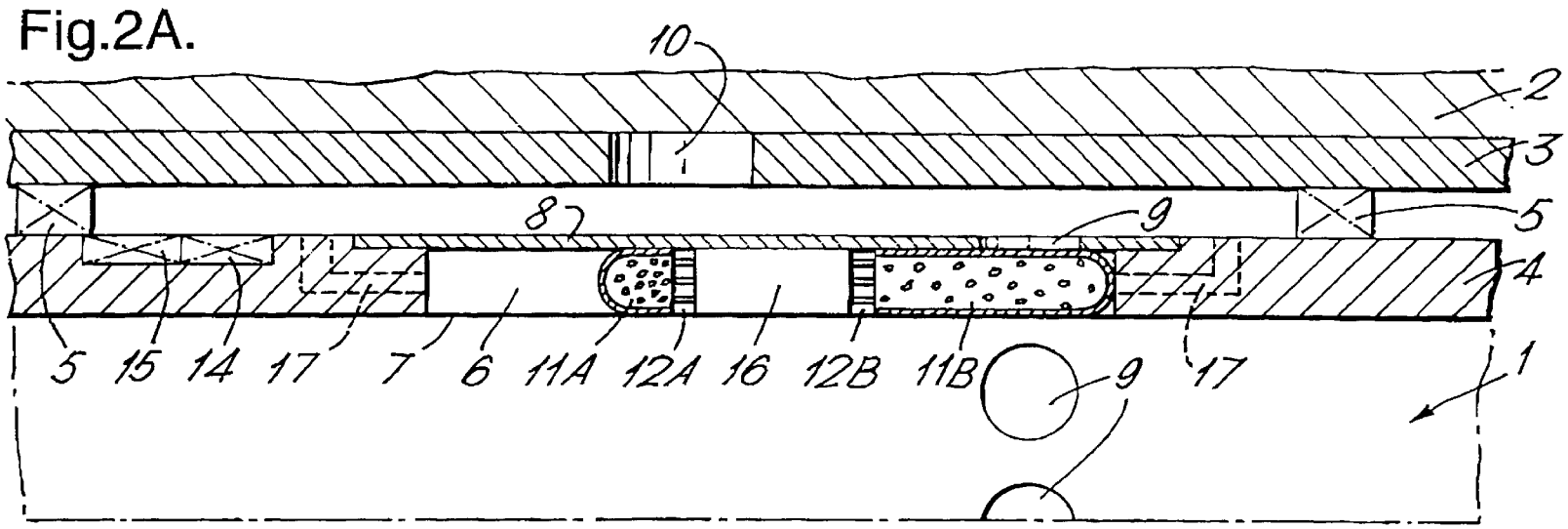
FIG. 2A shows an alternative embodiment of the device according to the invention in the open position thereof.
Figure 2B:
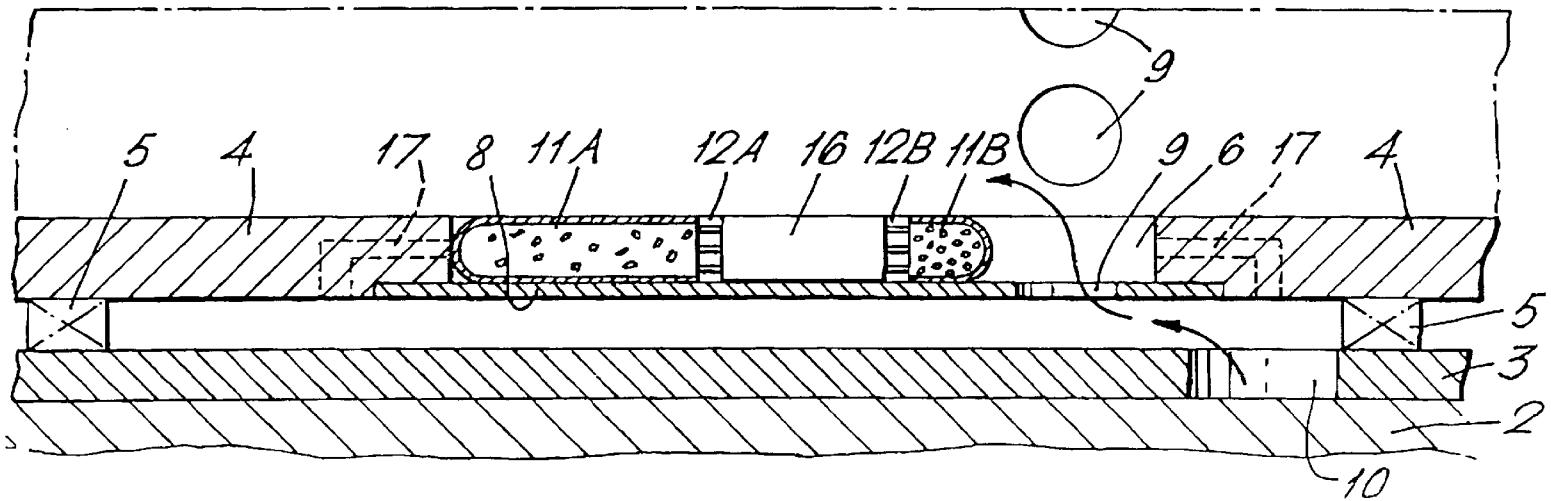
FIG. 2B shows the device of FIG. 2A in the closed position thereof.

FIG. 2A shows the device in the open position and FIG. 2B in the closed position.

Figure 3A:
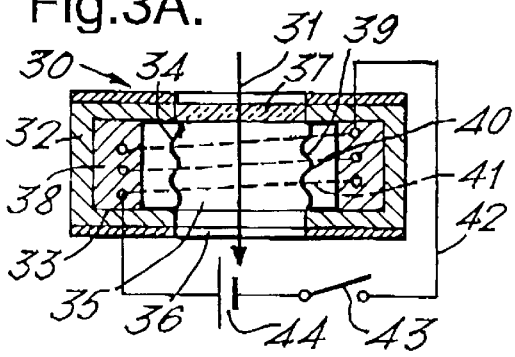
FIG. 3A shows yet another embodiment of the device according to the invention in the open position thereof.
Figure 3B:
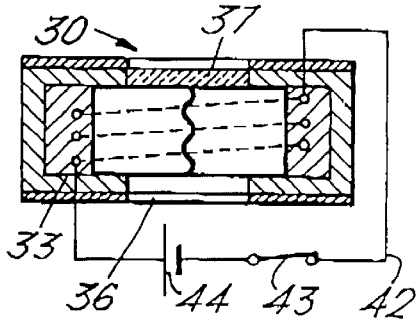
FIG. 3B shows the device of FIG. 3A in the closed position.
Figure 6:
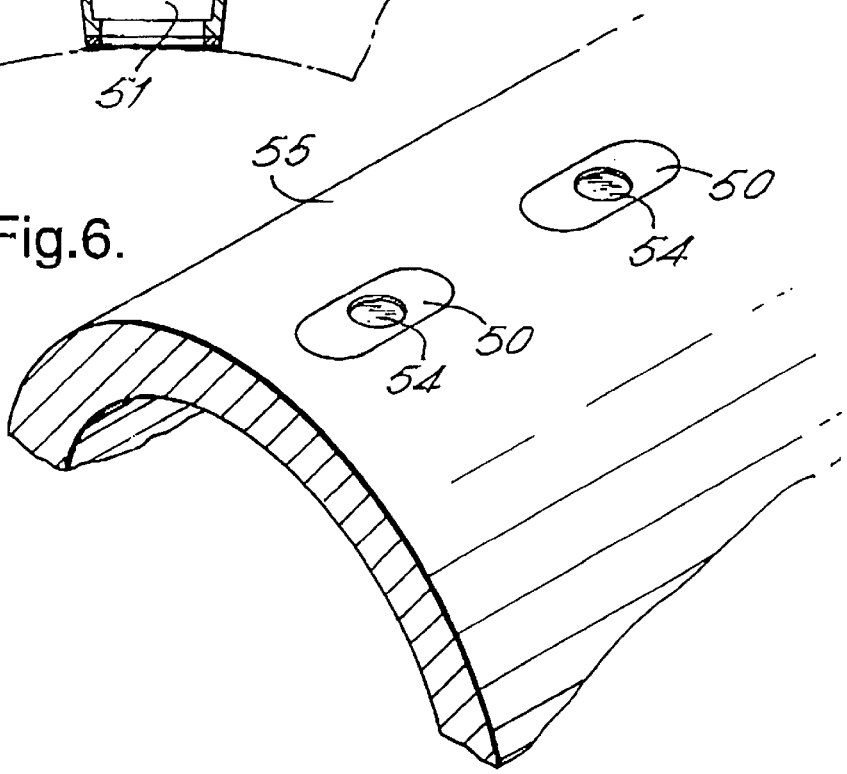
FIG. 6 is a three-dimensional view of the well tubular of FIG. 5 in which a plurality of devices according to the invention are embedded.

Referring to FIGS. 3A and 3B there is shown another embodiment of the downhole fluid flow control device according to the invention which can, as shown in FIG. 6, be embedded in an opening of a well tubular.

FIG. 3A shows the device 30 in the open position so that fluid is permitted to flow into the well as shown by arrow 31.

The device 30 comprises a disk-shaped housing 32, in which a disk-shaped cavity 33 is present.

A toroidal bladder 34 is mounted in the housing 32 such that a central opening 33 in the bladder 34 is aligned with a central fluid passage 36 in the housing 32. A sandscreen 37 is arranged at the entrance of the fluid passage 36 to prevent influx of sand and other solid particles into the well.

The bladder 34 is surrounded by a toroidal body of foam 38 of which the pores are filled with water. The foam also contains cells or granules that are filled with an expandable gas. The bladder 34 is filled with an electromagnetic field responsive gel 39 and has a cylindrical outer wall 40 which is permeable to water but impermeable to the gel 39.

An electrical coil 41 is embedded in the body of foam 38. The coil 41 forms part of an electrical circuit 42 which comprises an electric switch 43 and an electrical source 44 in the form of an in-situ rechargeable battery. The battery may be powered by passing a low voltage electrical current through the wall of the well tubulars and/or by a downhole electrical power generator (not shown) which is driven by a small fan or turbine which is itself rotated by the fluid flow through the well.

In FIG. 3A the switch 43 is open so that no electrical current flows through the coil 41. As a result no electromagnetic field is exerted to the gel 39 and the gel will release water which trickles through the water permeable outer wall 40 of the bladder 34 and is absorbed by the foam 38. This causes the gel 38 to shrink so that the bladder 34 contracts towards the cylindrical outer wall 40 thereof and a central opening 35 is created through which fluids are permitted to flow into the well as indicated by arrow 31.

In FIG. 3B the switch 43 is closed so that the electrical coil 41 induces an electromagnetic field to the gel 39. As a result the gel 39 will absorb water from the foam 38 via the cylindrical outer wall 40 of the bladder 34. This causes the gel 39 to swell so that the bladder 34 expands and thereby closes off the central fluid passage 36.

The switch 43 may be connected to a downhole sensor (not shown) which closes the switch if an influx of water through the device is detected. The sensor may also form part of a sensor assembly which monitors a range of parameters and which is connected to a data processing unit that is programmed to optimize the production of hydrocarbon fluids from the reservoir.

Figure 4A:
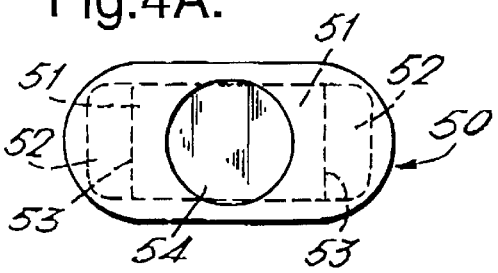
FIGS. 4A and 4B are schematic top- and three-dimensional views of slight modifications of the device of FIGS. 3A and 3B.
Figure 4B:
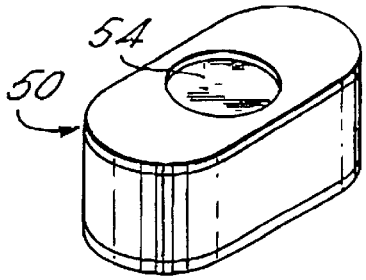

FIGS. 4A and 4B show an embodiment of a device according to the invention in which the housing 50 has an oblong or elliptical shape. As illustrated in FIG. 4A in that case the gel filled bladder 51 may be separated from a pair of bodies of water filled foam 52 by a pair of water permeable bulkheads 53. The central fluid passage may have a cylindrical or elliptical shape and contain a sandscreen 54 and the electric coil (not shown) is embedded in the housing 50.

Figure 5:
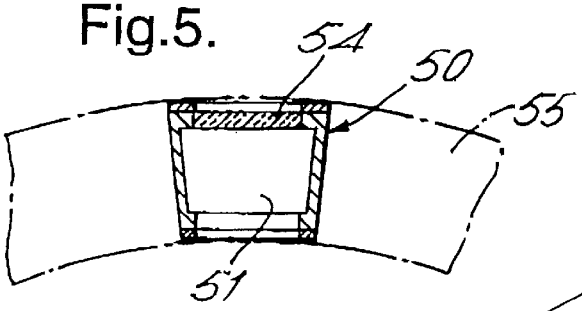
FIG. 5 shows a schematic cross-sectional view of the device according to FIGS. 4A and 4B in a well tubular.

FIG. 5 is a cross-sectional view of the device of FIGS. 4A and 4B which is embedded in the wall of a well tubular 55. FIG. 6 is a three-dimensional view of the well tubular 55 of FIG. 5 in which a pair of inflow control devices as shown in FIGS. 4A, 4B and 5 are embedded.

The housings 50 of the devices shown in FIG. 6 are oriented in a longitudinal direction with respect to the well tubular to allow that the housings 50 have a substantially flat shape which simplifies the manufacturing process.

It will be understood that the gel filled bladder may have a water permeable wall which is in contact with well fluids and which allows the gel to absorb and release water from and into the well fluids. In such case the wall of the bladder should be permeable to water, but impermeable to the gel and produced oil and/or gas.

It will also be understood that the electromagnetic field responsive gel may be replaced by another stimuli responsive gel such as a temperature responsive gel and that the bladder may be replaced by another deformable chamber, such as a cylindrical chamber where the gel induces a piston to move up and down in response to variations of the volume of the gel.

We claim:

1. A downhole device for controlling the flow of fluids through a hydrocarbon fluid production well, the device comprising a deformable chamber which contains a stimuli responsive gel, which gel has a volume that varies in response to variation of a selected physical stimulating parameter, the device further comprising a fluid passage which is closed off in response to a volume increase of at least part of the gel and the deformable chamber, wherein the gel is contained in a flexible bladder which seals off the fluid passage in response of a volume increase of at least part of the gel in the chamber.

2. The device of claim 1, wherein the flexible bladder has a toroidal shape and surrounds an orifice in a production liner in the inflow region of an oil and/or gas production well and wherein the gel in the flexible bladder is induced to swell so that the bladder seals off the orifice in response to the detection of influx of water into the well via the orifice.

3. The device of claim 2, wherein the flexible bladder comprises two segments which are separated by at least one bulkhead which is impermeable to the gel and which is at least temporarily permeable to water.

4. The device of claim 3, wherein said at least one bulkhead is made of a material which is permeable to water if an electromagnetic field is imposed on the bulkhead and which is impermeable to water if no electromagnetic field is exerted to the bulkhead.

5. The device of claim 4, wherein said at least one bulkhead separates two segments of the flexible bladder which each comprise an electromagnetic field responsive gel which releases water if an electromagnetic field of a certain field strength is exerted to the gel and which absorbs water in the absence of an electromagnetic field and the device comprises one or more electromagnetic sources which are adapted to selectively impose an electromagnetic field on one of the segments of the chamber and/or the bulkhead.

6. The device of claim 3, wherein the flexible bladder comprises two gel-filled segments which are separated by a pair of gel impermeable bulkheads which are separated by an intermediate segment of the chamber which is filled with water.

7. The device of claim 5, wherein the gel is selected from the group of polyacrylamide gels and polymethylacrylic acid gels.

8. The device of claim 1, wherein the flexible bladder has a toroidal shape and is arranged in an annular space between two co-axial production tubing sections of which the walls are perforated near one end of the annular space such that the perforations are closed off in response to a volume increase of at least part of the body of gel within the bladder and the perforations are opened in response to a volume decrease of at least part of the body of gel within the bladder.

9. A downhole device for controlling the flow of fluids through a hydrocarbon fluid production well, the device comprising a deformable chamber which contains a stimuli responsive gel, which gel has a volume that varies in response to variation of a selected physical stimulating parameter, the device further comprising a fluid passage which is closed off in response to a volume increase of at least part of the gel and the deformable chamber, wherein the gel is an electromagnetic field responsive gel which releases water if an electromagnetic field of a certain field strength is exerted to the gel and which absorbs water in the absence of an electromagnetic field and wherein the device is equipped with an electromagnetic field transmitter which is adapted to exert an electromagnetic field of a selected field strength to the gel.

10. The device of claim 9, wherein the gel is selected from the group of polyacrylamide gels and polymethylacrylic acid gels.

11. The device of claim 9, wherein the gel is contained in a flexible bladder which seals off the fluid passage in response of a volume increase of at least part of the gel in the chamber.

12. The device of claim 11, wherein the flexible bladder has a toroidal shape and surrounds an orifice in a production liner in the inflow region of an oil and/or gas production well and wherein the gel in the flexible bladder is induced to swell so that the bladder seals off the orifice in response to the detection of influx of water into the well via the orifice.

13. The device of claim 11, wherein the flexible bladder has a toroidal shape and is arranged in an annular space between two co-axial production tubing sections of which the walls are perforated near one end of the annular space such that the perforations are closed off in response to a volume increase of at least part of the body of gel within the bladder and the perforations are opened in response to a volume decrease of at least part of the body of gel within the bladder.

14. The device of claim 12, wherein the flexible bladder comprises two segments which are separated by at least one bulkhead which is impermeable to the gel and which is at least temporarily permeable to water.

15. The device of claim 14, wherein said at least one bulkhead is made of a material which is permeable to water if an electromagnetic field is imposed on the bulkhead and which is impermeable to water if no electromagnetic field is exerted to the bulkhead.

16. The device of claim 15, wherein said at least one bulkhead separates two segments of the flexible bladder which each comprise an electromagnetic field responsive gel which releases water if an electromagnetic field of a certain field strength is exerted to the gel and which absorbs water in the absence of an electromagnetic field and the device comprises one or more electromagnetic sources which are adapted to selectively impose an electromagnetic field on one of the segments of the chamber and/or the bulkhead.

17. The device of claim 14, wherein the flexible bladder comprises two gel-filled segments which are separated by a pair of gel impermeable bulkheads which are separated by an intermediate segment of the chamber which is filled with water.

18. The device of claim 16, wherein the gel is selected from the group of polyacrylamide gels and polymethylacrylic acid gels.

* * * * *